United States Patent [19]

Armstrong et al.

[11] Patent Number: 4,883,330

[45] Date of Patent: Nov. 28, 1989

[54] SPINE ASSEMBLY

[75] Inventors: Eric J. Armstrong, Pennsburg; David D. McClanahan, Lansdale, both of Pa.

[73] Assignee: Knoll International, Inc., New York, N.Y.

[21] Appl. No.: 193,239

[22] Filed: May 11, 1988

Related U.S. Application Data

[63] Continuation of Ser. No. 923,409, Oct. 27, 1986, abandoned, which is a continuation-in-part of Ser. No. 618,492, Jun. 8, 1984, Pat. No. 4,619,486.

[51] Int. Cl.[4] ..... A47B 17/00

[52] U.S. Cl. ..... 312/195; 312/223

[58] Field of Search ..... 211/26; 403/171; 312/263, 264, 194, 195, 223, 257 R

[56] References Cited

U.S. PATENT DOCUMENTS

| | | | |
|---|---|---|---|
| 3,276,833 | 10/1966 | Felstehausen | 312/223 |
| 3,883,202 | 5/1975 | Konig | 312/223 |
| 3,912,087 | 10/1975 | Zeischegg | 403/171 |
| 3,966,285 | 6/1976 | Porch et al. | 312/257 S K |
| 4,094,256 | 6/1978 | Holper et al. | 312/223 X |
| 4,377,724 | 3/1983 | Wilson | 174/48 |
| 4,461,519 | 7/1984 | Hildebrandt et al. | 312/223 X |
| 4,619,486 | 10/1986 | Hannah et al. | 312/196 X |

*Primary Examiner*—Joseph Falk

*Attorney, Agent, or Firm*—Thomas A. O'Rourke

[57] ABSTRACT

A spine assembly for supporting dest tops and panels and acessories and providing for the passage of electrical wires to the desk tops and panels and accessories, as needed. A housing is utilized open at a bottom portion for receiving the electrical wires. A framework is included within the housing. One or more frameworks serve as supports for brackets which extend upwardly in turn to support panels and accessories. The framework also serves as a support for desk tops as well as a cover assembly. The cover assembly provides an opening through which electrical wires pass from the interior of the housing to the exterior thereof. In addition, brackets extend through the cover assembly for supporting panels and accessories above the cover assembly. The spine assembly is free-standing, and may be closed off by end panels as an individual item or joined to one or more other spine assemblies to create a system of furniture.

14 Claims, 6 Drawing Sheets

SPINE ASSEMBLY

This application is a continuation of 06/943409 now abandoned, which is a continuation-in-part application of Application Ser. No. 618,492 filed June 8, 1984 now Pat. No. 4,619,486 and the disclosures of which are incorporated herein by reference.

BACKGROUND AND BRIEF DESCRIPTION OF THE INVENTION

This invention relates to office systems, and more particularly to a system of office furniture designed to provide maximum flexibility to the user in terms of mass produced components which may be used to form individual units or connected together to form assemblies of interconnected items.

Most office systems in use today are formed from free-standing panels which extend upwardly a significant distance above the normal desk top height. To these panels are affixed accessory items, such as storage cabinets, brackets for in turn supporting other items, and desk tops. The present invention is directed to what is termed a "spine" assembly which is preferably free-standing and of a height the same as that of a typical desk top. The spine assembly is the heart of the system, and may be free-standing itself as a completed item of furniture serving as a low-height panel. Its main function, however, is as a support for a desk top, and as a means for containing utility and communications lines to be distributed to the desk tops. Additionally, the spine assembly provides support for panels and other accessory items that may extend thereabove, as desired. Provision is made to join one spine assembly to another, so that the spine assemblies may be linked to form any desired configuration of interconnected spine assemblies and panels and desk tops and accessories, as desired.

The spine assembly advantageously comprises an interior framework which supports side panels and which includes, at its ends, means for attaching finishing end panels or posts to which may be attached one or more frameworks of other spine assemblies, as desired. The interior framework serves as a support for brackets extending upwardly therefrom in turn used to support desk tops and panels and accessories as well as a cover assembly. The cover assembly itself closes off the top of the housing defining the spine assembly, and provides an opening through which utility and communications lines pass from the interior of the housing to the exterior thereof. Additionally, brackets may extend upwardly through the cover assembly for supporting panels and other accessory items above the cover assembly.

The following patents are representative of the prior art:

| U.S. Pat. No. | Applicant(s) | Issue Date |
|---|---|---|
| 3,883,202 | Karl-Heinz Konig | 05/13/75 |
| | Title: DESK HAVING ELECTRICAL SUPPLY LINES WHICH ARE LAID IN THE TABLE | |
| 4,094,256 | Manfred Holper et al. | 06/13/78 |
| | Title: WORK TABLE HAVING LINES EMBODIED THEREIN | |
| 4,377,724 | Harold R. Wilson | 03/22/83 |
| | Title: SPACE DIVIDER WALL STRUCTURE WITH MULTIPLE CIRCUIT POWER SYSTEM | |

The invention will be more completely understood by reference to the following detailed description of a presently preferred embodiment thereof.

DETAILED DESCRIPTION

Figure 1:
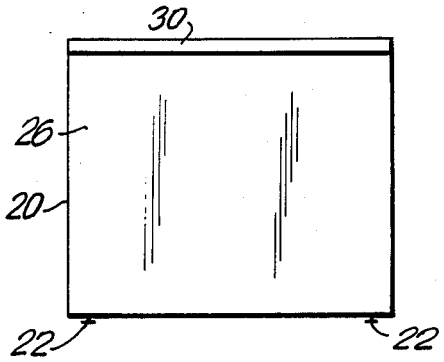
FIG. 1 is a side view of a spine assembly in accordance with the present invention.
Figure 3:
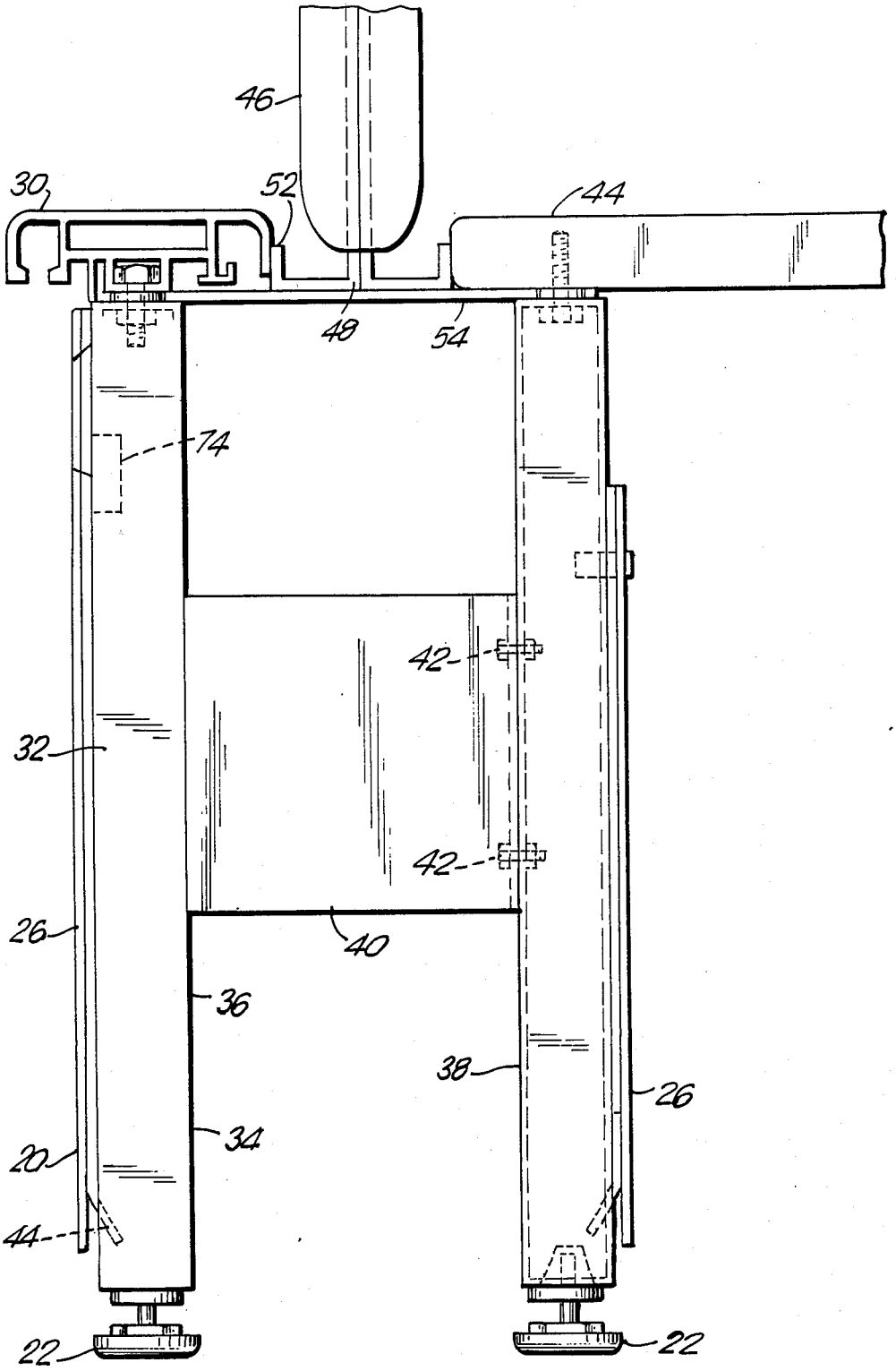
FIG. 3 is a end view of a spine assembly supporting a desk top.

A spine assembly 20 is shown in FIGS. 1 and 3. The spine assembly comprises a housing which is open at its bottom portion in order to receive utility and communications lines. The spine assembly is free-standing and is supported by leveling glides 22. The spine includes end panels, not shown, side panels 26 on both sides thereof and a cover assembly 30 all described in greater detail below.

Figure 4:
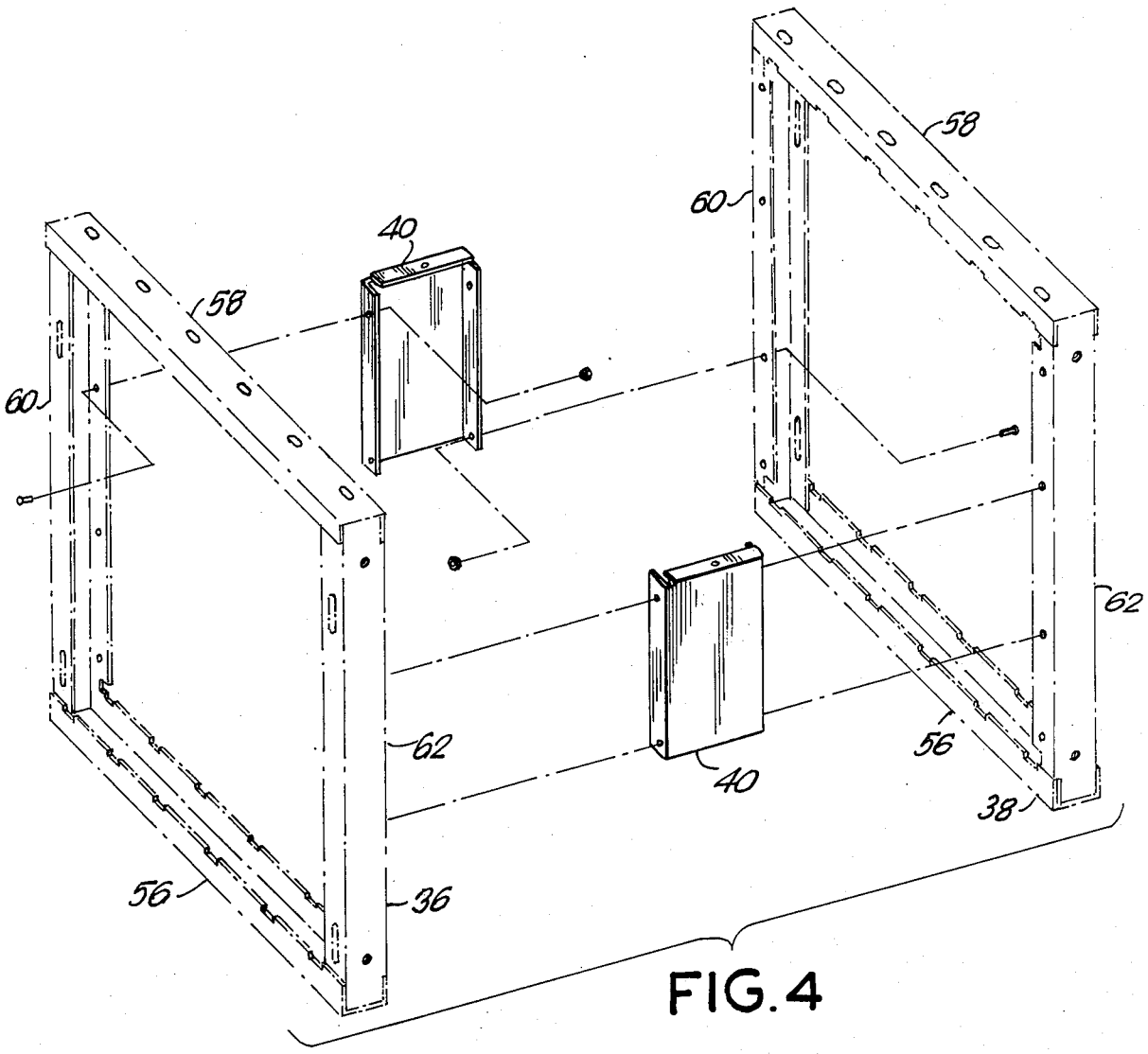
FIG. 4 is an exploded view of the framework of the spine assembly of FIG. 3.

As series of free standing spines 20 may be interconnected in a line and used to support a series of desk tops as shown in FIG. 4 of parent application Ser. No. 618,492.

Figure 2:
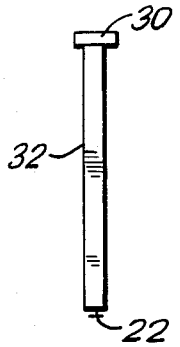
FIG. 2 is a end view of a spine support member.

In FIG. 2, a spine support member 32 is shown in an end view. The spine support member 32 and how it is part of the overall spine assembly is shown in more detail in FIG. 3.

FIG. 3 shows an end view of one of the spines of the present invention with the end panel removed. As shown it has a basic framework 34, supporting side panels 26 and is hollow in its interior to provide a housing for the passage of utility and communications lines. The basic framework 34 is defined by upwardly extending supports 36 and 38 which support at least one transverse member 40 located at approximately the midportion of the supports although transverse members may also be placed at the upper and lower portions of the upwardly extending supports. The transverse members 40 may be connected to the upwardly extending supports 36 and 38 by any suitable means such as for example nuts and bolts 42.

The side panel 26 may be connected to upwardly extending supports 36 and 38 by means of a downwardly extending flange 44 and which connects to horizontal flange 86. This is seen more clearly in FIG. 6 and described in more detail below. Side panel 26 is connected to the upper portion of the upwardly extending supports 36 and 38 and by means of a suitable connection such as a magnetic catch 74 at the upper portion of strut 36. Cover assembly 30 is connected to upper horizontal member 58.

In forming the spine assembly of the present invention two spine support members 32 may be joined together by the transverse member 40 as shown in FIG. 3. Alternatively, spacers 56 and 58 may be used in place of transverse member 40 to join the spine support members 32. When attaching a desk top 44 to the spine assembly of the present invention cover member 30 is removed.

Figure 7:
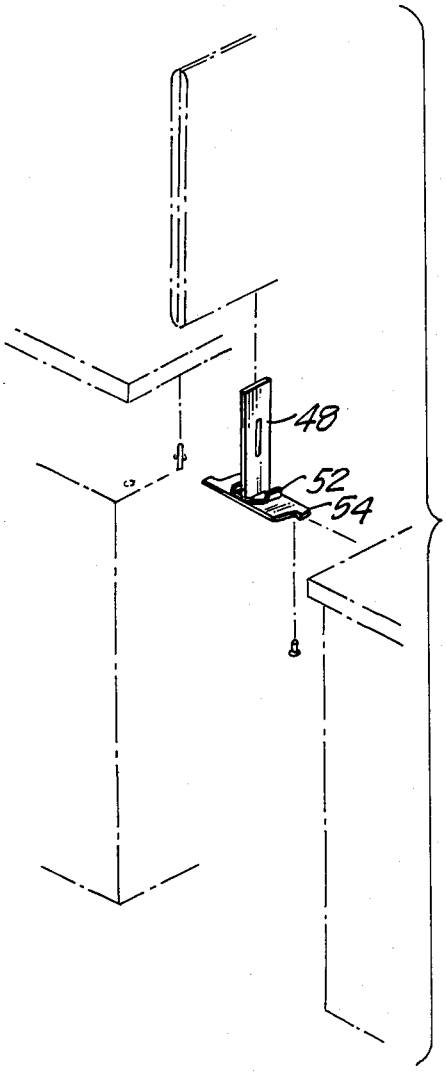
FIG. 7 shows one type of bracket that may be used with the spine assembly of the present invention to support a panel above the spine assembly.

A panel 46 may be supported above the spine by brackets 48 shown in more detail in FIG. 7.

Bracket 48 has a generally inverted "T" shape and has upwardly extending flanges 52 extending from the base 54 of the bracket. Holes are provided in the base of bracket 48 for connecting the bracket to upper horizontal member 50 and cover member 30.

FIG. 4 shows upwardly extending supports 36 and 38 in more detail. Upwardly extending supports 36 and 38 are a framework having a base and top members 56 and 58 respectively although a single horizontal member located approximately at the midpoint of the upwardly extending supports 36 and 38 may also be used. Base and top members 56 and 58 are connected to vertical members 60 and 62.

Figure 5:
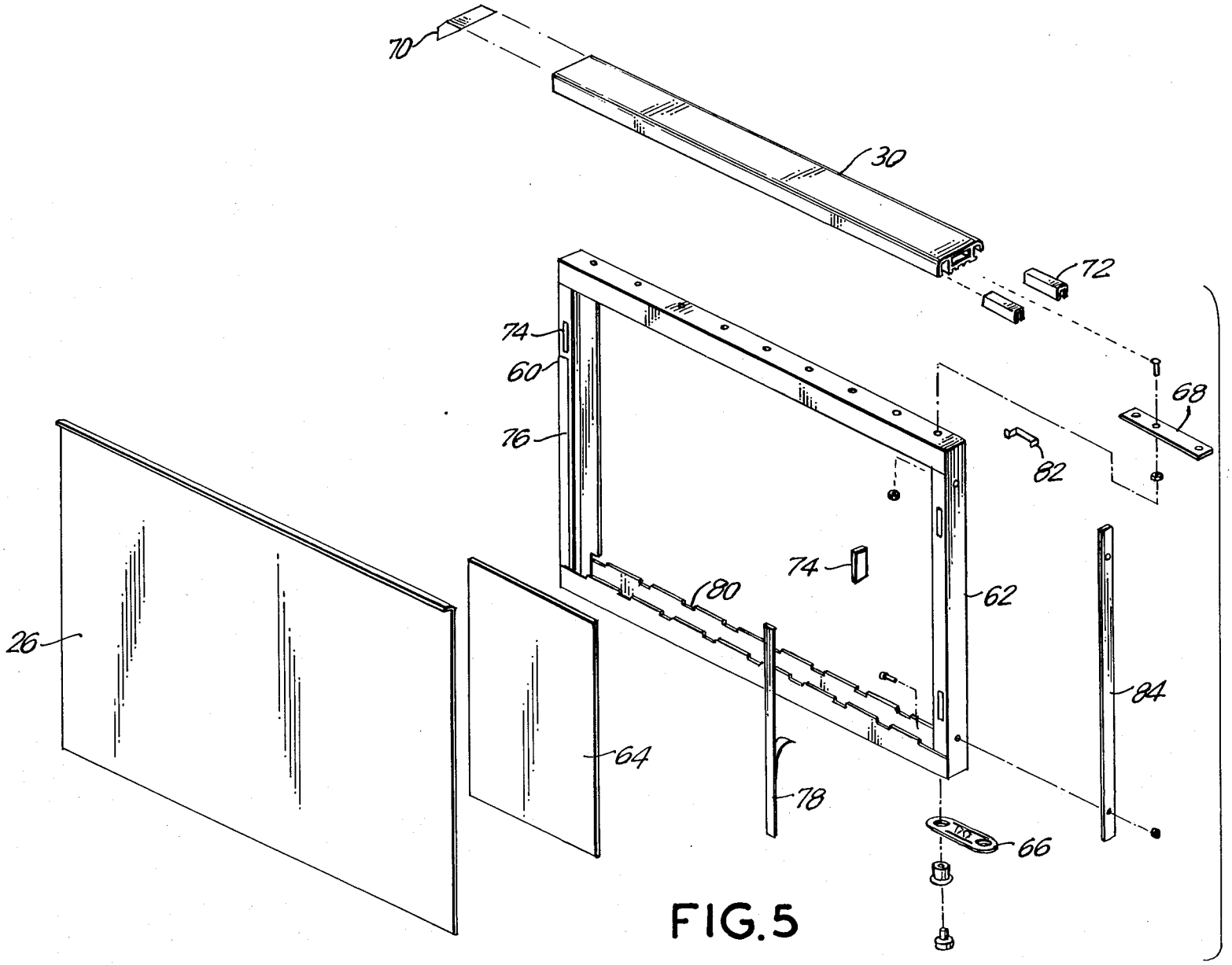
FIG. 5 is an exploded view of the spine support member of FIG. 2 & 3 view from one side.
Figure 6:
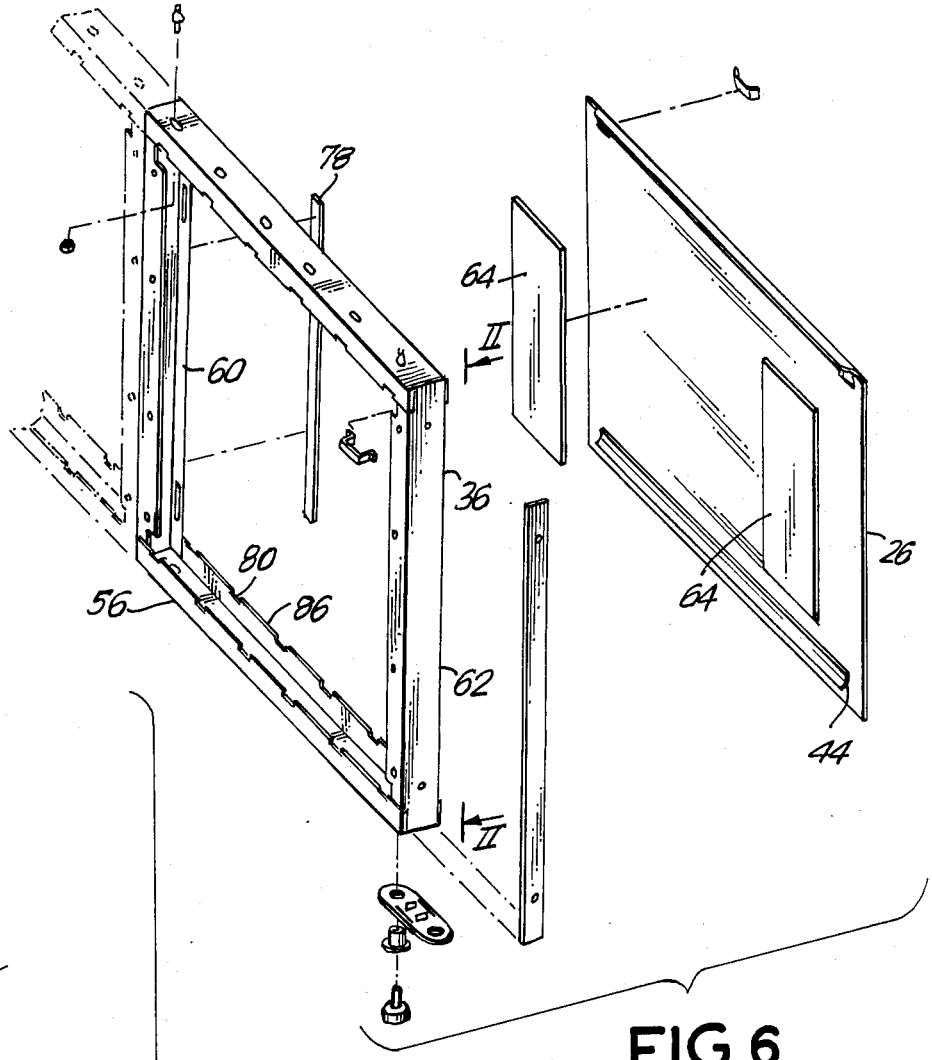
FIG. 6 is an exploded view of the spine support member of FIG. 3 viewed from the opposite side showing the inside of the side cover.

FIGS. 5 and 6 shows the configuration of upwardly extending support member 36 in preparation for connecting two or more spine assemblies in end to end fashion. Sound deading material 64 is attached to side panel 26. Glide bracket 66 is connected through leveling glides 22 to join two spine assemblies. Similarly, upper bracket 68 also is used to connect two spine assemblies in end to end fashion.

Cover assembly 30 is provided with an end piece 70 and spacers 72 are used when two spine assemblies are connected. Felt strips 76 and 78 having adhesive backings are placed on vertical members 60 and 62 to seal the opening between the upwardly extending support 36 and the side panel 26. Felt sealing strip 84 is placed between spine sections that are being assembled. The horizontal frame members 56 and 58 may be provided with notches 80 to permit mounting a non-metallic side panel. Removable clip 82 is used for installation and holds sections of the spine together until the top rails are assembled.

As shown in FIG. 6, flange 44 extends across a substantial section of side panel 26 and slip over the edge 86 of horizontal member 56.

SUMMARY

There has been described a spine assembly which is extremely versatile in providing support for an individual desk top or a plurality of desk tops, as well as upwardly extending panels and other accessories, as desired. The spine assembly forms a basic free-standing component, which may be used by itself, or in combination with other of such assemblies to form interconnected groupings of furniture, as desired.

It will be understood that persons skilled in the art may modify the presently preferred embodiment described herein. Accordingly, this invention should be taken to be defined solely by the following claims.

I claim:

1. A spine system assembly for supporting desk tops and panels and accessories comprising a plurality of housings joined end-to-end to create an interconnected network of such housings each housing being open on the bottom and adapted to being free-standing and comprising a first and second framework each framework being defined by first and second upwardly extending supports said first and second upwardly extending supports being connected by an upper and lower transverse member, said first and second frameworks being connected by at least one pair of transverse members said transverse members connecting the upwardly extending support of one framework with the upwardly extending support of said second framework to form a housing said housing having a spaced apart substantially parallel side panels removably connected to each of said frameworks, said frameworks lying totally within the space between said side panels, said frameworks being spaced apart from each other to permit the unimpeded laying of electrical wiring within each housing, said housing having a means for attaching end panels and said housing having a means for connecting one or more housings to form a spine assembly said housing being adapted to connect a bracket for supporting a panel above said housing and said housing being adapted to support a cover assembly and a desktop on its upper surface.

2. A spine assembly as in claim 1, in which said housing is open at a bottom portion for receiving electrical wiring.

3. A spine assembly as in claim 1, in which said vertical structural support members include at the ends thereof, means for attaching one framework to another.

4. A spine assembly as in claim 1, in which said cover assembly includes a strip of rigid material bounded by flexible material which may be deformed to permit electrical wiring to pass from the interior of said housing to the exterior thereof.

5. A spine assembly according to claim 1 wherein said housing is supported by leveling guides.

6. A spine assembly according to claim 1 wherein said side panels are connected at their lower portion to said framework by a downwardly extending flange.

7. A spine assembly according to claim 1 in which said housing includes a top cover assembly said cover assembly including a strip of rigid material bounded by flexible material which may be deformed to permit said bracket to pass through to support a panel.

8. A spine assembly as in claim 7, in which said side panels extend from the bottom portion of said housing to below said cover assembly, and having secondary panels supported by said framework for bridging the gap between said side panels and said cover assembly.

9. A spine assembly as in claim 7 in which said cover assembly includes a strip of rigid material bounded along two opposed parallel edges by flexible material which may be deformed, the flexible material along one of said edges permitting the passage therethrough of said one or more brackets serving as support for an accessory above said spine assembly, the flexible material along the other of said edges permitting the passage of electrical wiring from the interior of said housing to the exterior thereof.

10. A spine assembly according to claim 1 wherein said first and second upwardly extending supports and said upper and lower transverse members are generally U-shaped in cross section with the open portion on the inner perimeter of said framework and having a flat base on the outer perimeter of the framework and wherein said transverse member connecting the first and second frameworks have first and second vertical members adapted to connect said upwardly extending supports of said frameworks.

11. A spine assembly for supporting desk tops and panels and accessories being open at the bottom and being adapted to be free-standing comprising a first and second framework each framework being defined by first and second upwardly extending supports said first and second upwardly extending supports being connected by an upper and lower transverse member, said first and second frameworks being connected by at least one pair of transverse members said transverse members connecting the upwardly extending support of one framework with the upwardly extending support of said second framework to form a housing said housing having a spaced apart substantially parallel side panels removable connected to each of said frameworks, said frameworks lying totally within the space between said side panels, said frameworks being spaced apart from each other to permit the unimpeded laying of electrical wiring within each housing, said housing having a means for attaching end panels and said housing having a means for connecting one or more housings to form a spine assembly said housing being adapted to connect a bracket for supporting a panel above said housing and said housing bring adapted to support a cover assembly and a desktop on its upper surface.

12. A spine assembly according to claim 11, wherein said side panels are connected to said framework by a downwardly extending flange.

13. A spine assembly according to claim 12, wherein sound deadening material is attached to said side panels.

14. A spine assembly according to claim 11 wherein a guide bracket is provided through said leveling guides to join a second housing.

* * * * *